US009909269B2

(12) United States Patent
Wijnant

(10) Patent No.: US 9,909,269 B2
(45) Date of Patent: Mar. 6, 2018

(54) DIFFRACTOR FOR DIFFRACTING SOUND

(71) Applicant: 4SILENCE B.V., Oldenzaal (NL)

(72) Inventor: Ysbrand Hans Wijnant, Enschede (NL)

(73) Assignee: 4SILENCE B.V., Oldenzaal (NL)

( * ) Notice: Subject to any disclaimer, the term of this patent is extended or adjusted under 35 U.S.C. 154(b) by 0 days.

(21) Appl. No.: 14/903,160

(22) PCT Filed: Jul. 7, 2014

(86) PCT No.: PCT/NL2014/050455
§ 371 (c)(1),
(2) Date: Jan. 6, 2016

(87) PCT Pub. No.: WO2015/005774
PCT Pub. Date: Jan. 15, 2015

(65) Prior Publication Data

US 2016/0362855 A1 Dec. 15, 2016

(30) Foreign Application Priority Data

Jul. 7, 2013 (NL) ..... 1040287
Dec. 6, 2013 (NL) ..... 2011906

(51) Int. Cl.
*E01C 1/00* (2006.01)
*E01F 1/00* (2006.01)
(Continued)

(52) U.S. Cl.
CPC ..... *E01F 8/0094* (2013.01); *E01B 19/003* (2013.01); *E01C 1/002* (2013.01);
(Continued)

(58) Field of Classification Search
CPC ..... E01C 1/002; E01B 19/003; E01F 8/0094; E01F 8/0005; E01F 8/0017; E01F 8/0029; E01F 8/0041
(Continued)

(56) References Cited

U.S. PATENT DOCUMENTS 4,015,682 A * 4/1977 Keller ..... G10K 11/16 181/210
4,158,401 A 6/1979 Matsumoto et al.
(Continued)

FOREIGN PATENT DOCUMENTS

DE 2729248 A1 1/1979
DE 3134473 A1 3/1983
(Continued)

*Primary Examiner* — Jeremy Luks
(74) *Attorney, Agent, or Firm* — Knobbe, Martens, Olson & Bear, LLP

(57) ABSTRACT

Diffractor for diffracting sound of traffic on a travel surface with at least one diffraction plate disposed laterally beside the travel surface. The diffraction plate is provided with a pattern of recesses in the upper surface thereof for the purpose of diffracting the traffic noise in a direction which differs from the lateral direction. Each of the recesses is divided into individual resonators by intermediate walls provided in the recesses. The recesses have acoustically substantially non-absorbing walls and are free of acoustically absorbing material. The intermediate walls between adjacent resonators have at least one throughflow opening along which the rainwater can flow from the one resonator to the other.

31 Claims, 9 Drawing Sheets

(51) Int. Cl.
*E01F 8/00* (2006.01)
*E01B 19/00* (2006.01)

(52) U.S. Cl.
CPC ..... *E01F 8/0005* (2013.01); *E01F 8/0017* (2013.01); *E01F 8/0029* (2013.01); *E01F 8/0041* (2013.01)

(58) Field of Classification Search
USPC ..... 181/210
See application file for complete search history.

(56) References Cited

U.S. PATENT DOCUMENTS

| | | | | |
|---|---|---|---|---|
| 4,244,439 | A | 1/1981 | Wested | |
| 5,730,548 | A * | 3/1998 | Brero | E01C 3/06 181/210 |
| 5,959,265 | A * | 9/1999 | Van Ligten | G10K 11/172 181/286 |
| 6,253,872 | B1 * | 7/2001 | Neumann | E01B 19/003 105/452 |
| 8,132,644 | B2 * | 3/2012 | Van Veen | B64F 1/26 181/210 |
| 2005/0178613 | A1 * | 8/2005 | Humphries | B64F 1/26 181/285 |
| 2005/0194205 | A1 * | 9/2005 | Guo | G10K 11/16 181/210 |

FOREIGN PATENT DOCUMENTS

| | | | |
|---|---|---|---|
| DE | 19706708 | A1 | 11/1998 |
| WO | WO 2011/049454 | A2 | 4/2011 |

* cited by examiner

DIFFRACTOR FOR DIFFRACTING SOUND

CROSS REFERENCE TO RELATED APPLICATIONS

This application is the U.S. National Phase application under 35 U.S.C. § 371 of International Application No. PCT/NL2014/050455, filed Jul. 7, 2014, designating the U.S. and published in English as WO 2015/005774 A1 on Jan. 15, 2015 which claims the benefit of the Netherlands Patent Applications NL 1040287, filed Jul. 7, 2013 and NL 2011906, filed Dec. 6, 2013. Any and all applications for which a foreign or a domestic priority is claimed is/are identified in the Application Data Sheet filed herewith and is/are hereby incorporated by reference in their entirety under 37 C.F.R. § 1.57.

TECHNICAL FIELD

The present disclosure relates generally to diffraction of sound of traffic on a travel surface. In particular, the disclosure relates to a diffractor for diffracting sound of traffic on a travel surface, an assembly of a travel surface and one or more such diffractors.

BACKGROUND

The travel surface can be a railway or traffic road, although the invention is likewise applicable to other travel surfaces such as runways of an airport, wherein the air traffic causes lateral emission of aircraft noise. Different options are known for limiting, at least for determined frequency ranges, the lateral emission of sound originating from sound sources travelling over a railway, traffic route or runway (motor vehicles such as cars, trucks, motorbikes, trains and the like). A first option is to place a noise-reducing screen or a noise barrier along the travel surface. The sound coming from the sound source (i.e. sources originating from motorized road traffic or a train) is reflected and/or absorbed by the noise-reducing screen, whereby a low-noise zone is created behind the noise-reducing screen. The sound level at ground surface level or thereabove is therefore generally lower behind the noise-reducing screen (as seen from the travel surface) than in front of the noise-reducing screen.

Such noise-reducing screens or noise barriers are however expensive provisions, may be perceived as unattractive and often require complex constructions, particularly in respect of the foundation, in light of the high forces which are exerted on noise-reducing screens as a result of wind. The noise-reducing screens or noise barriers further obstruct the view of the surrounding area for the traffic participant, which can be perceived as disagreeable.

The noise of the traffic is determined by a number of different sound sources. In the case of motorized road traffic there are sources such as the engine, the tyres (rolling noise of tyres over the roadway, dominant above a speed of 30 km/hour) and the noise caused by the flow of the air round the vehicle. Similar sound sources can be identified in the case of rail traffic. These sound sources are usually located relatively close to the ground (i.e. the travel surface), characteristically at a distance of less than a meter therefrom. Use is made hereof in an alternative to the above stated noise-reducing screens or noise barriers. In the document WO 2011 049454 A2, the content of which should be deemed as incorporated herein, the lateral emission of sound is prevented by a number of resonators arranged parallel along the travel surface. These resonators are not configured to cause sound absorption but provide for an effective diffraction of the sound incident in substantially shearing manner from the sound sources. The resonators create a diffracting effect which depends on the associated resonance frequency of the air in the resonator. This resonance frequency depends on, among other factors, the form and dimensions (i.e. the dimensioning) of the relevant resonator. In addition, the resonance frequency of a resonator depends on the dimensions of the resonators located nearby.

The sound in a determined frequency range can be diffracted in upward direction when resonators with different resonance frequencies are applied. This diffraction is of course dependent on the frequency. Since the most dominant tones in traffic noise generally lie in a limited frequency range, for instance from 800 Hz to 1200 Hz, a suitable diffraction can be realized in the relevant frequency range with a correct dimensioning and positioning of the resonators.

A noise reduction takes place at a determined angle relative to the horizontal, up to about 30° to 40°, in that the sound is effectively diffracted upward, i.e. above said determined angle. This effect takes place in a lateral direction (relative to the travel surface, i.e. perpendicularly of the longitudinal direction of the travel surface). The closer the resonators are disposed to the sources, the greater the angle to be realized becomes within which a considerable noise reduction can be realized.

Because the resonators can be placed relatively close to the sound sources, the 'screening' effect of resonators can be said to be considerable. The surrounding area, i.e. particularly the neighbourhood with for instance houses behind the diffractors, as seen from the travel surface, for which the angle relative to the horizontal will amount in practice to no more than a few degrees (depending on the distance between the travel surface and buildings), will generally be exposed to a greatly reduced level of traffic noise. The resonators are further arranged in the ground along the travel surface, or form part thereof. Because they are located very close to the ground they are less of a problem from a visual viewpoint, and substantially lower forces resulting from wind load are exerted.

The known resonators do however have a number of drawbacks.

A first drawback is that rainwater or other liquids may penetrate the resonators. If this is the case, the diffracting action of the resonators, and thereby the effective sound attenuation, decreases immediately. The rainwater can get into the resonators directly in the form of rain, but can also be the result of water being splashed from the surface of the roadway. The intermediate walls between adjacent resonators are closed and ensure that rainwater which has penetrated a resonator also remains contained in the resonator. In order to nevertheless enable drainage of rainwater the above stated publication WO 2011 049454 A2 proposes arranging in the bottom of the resonators drainage channels along which the water can be drained. As shown more specifically in FIG. 7 of this publication, drainage pipes are connected to openings in the bottom of the resonators. Surprisingly however, it has been found that these drainage channels can in some cases have a negative effect on the operation of the resonators such that a reduced sound attenuation is realized.

A further drawback of the known resonators is that they have a length such that traffic nevertheless travelling over the resonators, particularly two-wheeled vehicles such as cycles or motorbikes, may be adversely affected thereby.

The front or rear tyre of such vehicles may find their way into the resonators, which can result in dangerous situations.

SUMMARY

It is an object of the invention to obviate at least one of the above stated drawbacks and/or other prior art drawbacks. It is a further object of the invention to provide a diffractor and a system of the type stated in the preamble in which a good drainage can be realized (substantially) without the relevant acoustic properties of the diffractors being adversely affected thereby.

Another object of the invention is to realize a diffractor which has an even greater sound attenuation than the known resonators in the relevant frequency range and in the relevant area behind the diffractor.

According to a first aspect of the invention, at least one of the objects is at least partially achieved in a diffractor of the type stated in the preamble wherein each of the recesses is divided into individual resonators by intermediate walls provided in the recesses, wherein the recesses have acoustically substantially non-absorbing walls and are free of acoustically absorbing material, and wherein the intermediate walls between adjacent resonators comprise at least one throughflow opening along which the rainwater can flow from the one resonator to the other.

By providing the throughflow openings in the intermediate walls instead of in the bottom and/or the longitudinal walls and by mutually connecting adjoining resonators via a throughflow opening it has surprisingly been found possible to easily drain water which may have entered the resonators without the diffracting action of the resonators being reduced to any considerable extent. This ensures that the diffractors can function properly at all times, also for instance after a shower of rain which has filled the resonators with water.

A concrete support plate is otherwise known from the German document DE 197 06 708 A1. Train rails can be fixed to this concrete plate. Acoustically absorbing plates are arranged between the rails and on the concrete plate, these plates being provided with openings in the form of a truncated cone. Each of these openings ends a short distance above the concrete plate. However, in view of the acoustically absorbing material applied, use is not made of diffraction in this known construction, and the known construction is not therefore a diffractor.

When reference is made here to the term substantially non-absorbing walls, this is understood to mean walls with a very low absorption coefficient, for instance an absorption coefficient in the relevant frequency bands of below 0.2, in particular below 0.1.

In a determined embodiment an intermediate wall comprises a throughflow opening at the position of one of the (longitudinal) walls of the recess. The throughflow opening can for instance be a standing gap-like opening in the intermediate wall or between a free outer end of the intermediate wall and one of the (longitudinal) walls of the recess. In order to disrupt the incident sound field as little as possible it is recommended to provide the opening, in particular the standing gap-like opening, on the travel surface side of the recess. In an embodiment of the invention the throughflow opening is therefore provided between the wall of a recess to be positioned closest to the sound source and a free outer end of an associated intermediate wall.

In other embodiments of the invention the throughflow opening is located between the underside of the intermediate wall and the bottom of the recess. The throughflow opening can for instance be (though not limited to) a lying gap-like opening between the bottom of the recess and the underside of an intermediate wall. In this embodiment the water can also be drained properly without the openings required for the purpose resulting in any considerable loss of diffraction of the incident sound field.

The gap-like opening can be realized by giving the bottom of the recess a deepened form over at least a part thereof and/or by shortening the intermediate wall to some extent on the underside.

The bottom of a recess preferably lies at an incline in order to bring about flow of the water. In determined embodiments the incline is embodied both in the longitudinal direction of the recesses (and so parallel to the longitudinal axis of the travel surface) and transversely thereof to enable good drainage of the rainwater which has entered the recesses. In determined embodiments the incline is further such that the water is drained via the throughflow openings in one direction along the bottom, for instance to one of the sides of the diffractor where further provisions are present with which the water can be drained to the bottom. In determined embodiments an infiltration pack is further arranged under the diffractors in order to realize good drainage.

In determined embodiments the diffraction element comprises a lower plate and an upper plate placeable on the lower plate. The bottom of the recesses is formed here by the upper side of the lower plate and recesses are arranged only in the upper plate. The above stated embodiment with the throughflow opening under the intermediate wall can for instance be embodied in this way. In other embodiments the diffraction element can however be formed integrally. The diffraction element can then take a monolithic form, which has practical advantages in respect of durability and manufacturability.

When the diffraction element has a releasing form, this is understood to mean that it could be manufactured in a mould. A concrete diffraction element can for instance be manufactured by filling a mould with concrete mortar, allowing the concrete mortar to cure and removing the resulting product from the mould. This means that the diffraction elements can be manufactured in efficient manner.

Instead of or in addition to being made from concrete, a diffraction element can also be manufactured from another acoustically hard material, such as plastic. An example of a suitable type of plastic is glass fibre-reinforced polyester, recycled polyethylene or a steel-reinforced plastic. In other embodiments the diffraction element is manufactured from metal such as steel or iron. In yet other embodiments the diffraction element is manufactured partly from a first material (for instance one of the above stated materials) and partly from a second material differing from the first material (for instance another of the above stated materials).

An example of a monolithic diffraction element which moreover has a releasing form can be the above stated embodiment in which the throughflow opening is a standing gap-like opening provided adjacently of an intermediate wall.

According to a second aspect of the invention, at least one of the objectives is at least partially achieved in a diffractor of the type stated in the preamble, wherein the recesses have acoustically substantially non-absorbing walls and are free of acoustically absorbing material and wherein, in a situation where they are arranged along the travel surface, the recesses are arranged as seen from the travel surface in a number of successive parallel rows of resonators, wherein the depth of the recesses decreases per row in the direction away from the travel surface.

It has been found that the sound attenuation result improves when the rows of recesses located the shortest distance from the travel surface are deeper than the recesses located at a greater distance. It has further been found that the result can be said to be good when the depth of the recesses decreases monotonically per row as the distance relative to the travel surface increases.

The depth of the recesses in a row is otherwise preferably substantially constant in order to obtain essentially a diffraction along the travel surface which does not depend on the position of the sound source. From practical considerations the depth inside a row of recesses can still vary to some extent. The variations are however so small that they do not affect the diffraction result, or hardly so. As described above, it may be advisable to drain possible rainwater by placing the recesses at an incline so that the water will flow in a desired direction.

It is further not always necessary to give all rows a decreasing depth. It has been found that reasonably good results can already be achieved when the depths of at least four of the mutually adjacent rows, preferably at least ten of the mutually adjacent rows, decrease.

It has been explained above that the dimensioning and arrangement of resonators can be performed such that the greatest noise reduction takes place in a determined desired angular range relative to the horizontal in the direction away from the travel surface and beyond the resonators. It has however been found that a correct dimensioning and arrangement of the resonators can also result in the greatest noise reduction in other angular ranges, for instance from 20° to 50° (depending on the preferred way in which the diffraction lobe should extend). In other words, instead of aiming for a greater noise reduction at or just above ground level, the reducing effect of the resonators can also be maximized at a distance of for instance 7.5 m from the travel surface, behind the diffractors, for higher positions, for instance 1.5 meters or 3 meters above ground level, depending on where the greatest nuisance from traffic noise is expected to occur. It has further been found that there is a correlation between the sound level at a height of 3 m and the far-field sound level. A great reduction at a height of 3 m can thus be advantageous for noise reduction far afield.

In a further embodiment the recesses have a form wherein the width (b) of the recesses is smaller at the mouth than at the bottom, wherein the recesses preferably widen at least partially from the mouth to the bottom. This makes it possible to realize diffraction at lower frequencies while the thickness remains the same, this being desirable for instance for goods traffic.

In order to ensure a suitable diffraction of the incident sound field it is advisable to make the surface area of the resonating elements, i.e. the overall surface area of the orifices of the recesses in the diffraction element, as large as possible. This applies specifically to all resonators in a row. In embodiments of the invention this can be achieved by having the porosity (overall surface area of the orifices divided by the overall upper surface area of the diffraction plate) be at least 10%, preferably more than 50% or even more than 60%, this of course within the structural possibilities. The intermediate walls or partitions are further as small as possible in order to obtain a relatively great porosity.

In order to ensure that two-wheeled road traffic no longer runs the risk of a wheel finding its way into the recesses, it is further recommended that the intermediate distance between intermediate walls of a resonator amounts to less than 20 cm, preferably less than 10 cm. The distance between an intermediate wall and a longitudinal wall (i.e. the width of the throughflow opening) may further not become too great either since two-wheeled traffic could then still encounter problems. The width of the throughflow opening is characteristically about 5 mm.

The resonators are dimensioned such that the resonance frequencies thereof lie in the range relevant to the sound sources in question. The resonance frequencies for car traffic preferably lie between 700 Hz and 1200 Hz. Lower frequencies may be involved in the case of goods traffic, for instance from 500 Hz to 1200 Hz. Frequencies in the order of magnitude of 100 Hz may even be involved in the case of air traffic, and there are also resonators having their resonance frequencies in these lower frequency ranges.

According to a third aspect of the invention, at least one of the objectives is at least partially achieved in an assembly of a travel surface for traffic, particularly a traffic road for motorized road traffic and/or a railway for train traffic, and at least one row of diffractors of the type described here. The diffractors are arranged here for limiting, at least for determined frequency ranges, the lateral emission of the sound from sound sources travelling over the travel surface. The diffractors are preferably placed as close as possible to the sound sources in order to make the diffracting effect of the diffractors as great as possible. This means that the row of diffractors is preferably arranged directly adjoining the travel surface. A diffractor can be placed on a single side of the travel surface or on both sides of the travel surface. This is also understood to include the option of arranging a diffractor at the position of the central reservation. The sound (coming from different carriageways) is then thus diffracted from both sides.

It is further advantageous to have the upper side of the diffraction element of the diffractor extend at least at roughly the same height as the surface of the travel surface. This is particularly important for the first pair of rows of resonators, so those lying closest to the travel surface. It is also good, or in some cases even better, for the resonator rows lying further away to be positioned somewhat higher than the first rows. Recesses on the side of the travel surface can be provided for the purpose of collecting and discharging water and/or dirt which would otherwise flow over the diffraction plate or into the recesses therein.

Although in many embodiments of the invention the diffractors produce a sufficient attenuation of the noise, and no further acoustic measures need therefore be taken, in determined embodiments the assembly can comprise a noise-reducing screen disposed behind the at least one row of diffractors for the purpose of reflecting and/or absorbing sound diffracted by the diffractors. Since the sound is diffracted upward and the noise-reducing screen is generally placed at a greater distance from the travel surface than the diffractors, the screen need only have its screening action from a determined minimum height. The screen starts for instance just below the diffraction lobe. This provides the option of giving an area from the ground to the noise-reducing screen a wholly or partially visually and/or acoustically open form, so that the traffic participant obtains a better view of his/her surroundings. In determined embodiments the assembly comprises a support for supporting the noise-reducing screen at a distance above the ground.

The noise-reducing screen itself can additionally be embodied on the noise-impacted side (front side and optionally the upper side) for acoustic absorption in the relevant frequency range. It is also possible to arrange additional diffractors on the upper side of the noise-reducing screen so that the sound shearing along the upper side of the noise-reducing screen can be diffracted still further.

In further embodiments of the invention the assembly comprises one or more further rows of diffractors, each disposed at a respective position at a greater distance relative to the travel surface and at greater height than the preceding row of diffractors. The sound can be diffracted further upward by placing an additional row of diffractors behind the first row of diffractors, this at a higher position than the first row of diffractors (more particularly at a height position just below the diffraction lobe of the first row of diffractors). A third row of diffractors can also be placed behind the second row of diffractors, wherein the height of the diffractors of the third row is greater than the height of the second row (more particularly at a height position just below the diffraction lobe of the second row of diffractors). This can be repeated for further rows, resulting in a cascade of rows of diffraction elements which diffract the sound increasingly further upward.

BRIEF DESCRIPTION OF THE DRAWINGS

Further advantages, features and details of the present invention will be elucidated on the basis of the following description of several embodiments thereof. Reference is made in the description to the figures, in which.

DETAILED DESCRIPTION

The invention relates to a diffractor for diffracting sound of traffic on a travel surface, the diffractor comprising at least one diffraction element to be disposed laterally beside the travel surface, wherein the diffraction elements are provided with a pattern of recesses in the upper surface thereof for the purpose of diffracting the traffic noise in a direction which differs from the lateral direction. The invention also relates to an assembly of a travel surface and one or more such diffractors.

Figure 1:
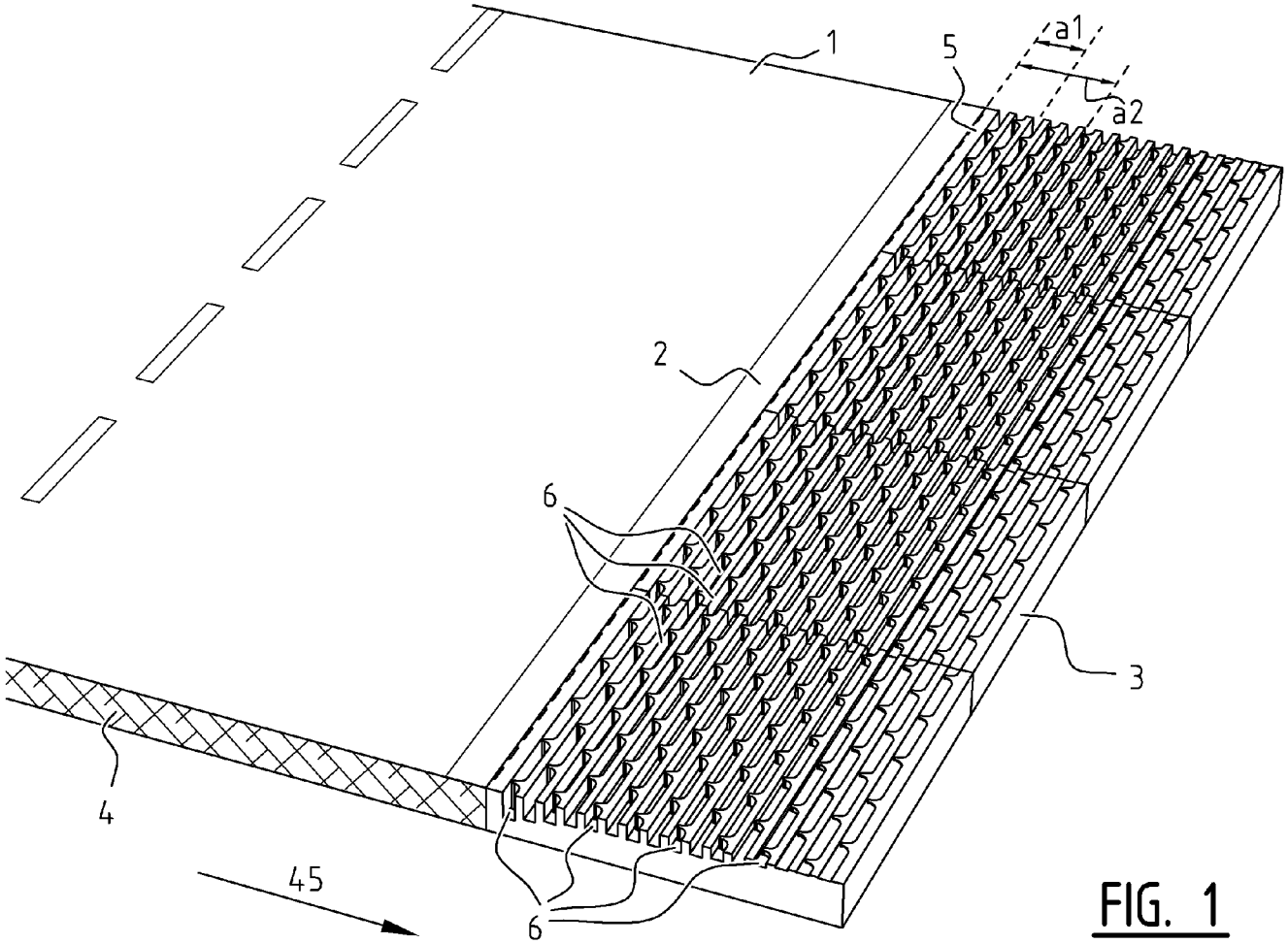
FIG. 1 is a partially cut-away perspective view of a carriageway with a number of diffractors in the form of diffraction elements placed in a row along the travel surface.

FIG. 1 shows a travel surface 1, more particularly a carriageway, along the shoulder 2 of which a row of diffraction elements 3 is arranged. The figure shows four diffraction elements, although it will be apparent that this number can be greater. Each of the diffraction elements 3 is recessed into the ground 4 such that, at least in the vicinity of the side of the travel surface 2, the upper surface 5 of the plate lies roughly at the same height as the carriageway.

The diffraction element has a pattern of slot-like recesses (including deepened portions, cavities, channels, trenches, grooves and the like) 6 which extend in longitudinal direction and optionally in mutually parallel zones, these slot-like recesses being bounded by two standing walls, which walls are optionally connected to each other locally by means of transverse partitions or intermediate walls. Recesses 6 are arranged at different distances ($a_1$, $a_2$) relative to the roadside 2 of travel surface 1 (in a lateral direction 45 away from the travel surface, i.e. perpendicularly of the longitudinal axis of the travel surface).

The upper side of diffraction element 3 can be arranged at a slight incline relative to the travel surface so that the height increases as said distance (a) increases. In other embodiments the upper side of the diffraction element is however wholly coplanar with travel surface 1.

Figure 2A:
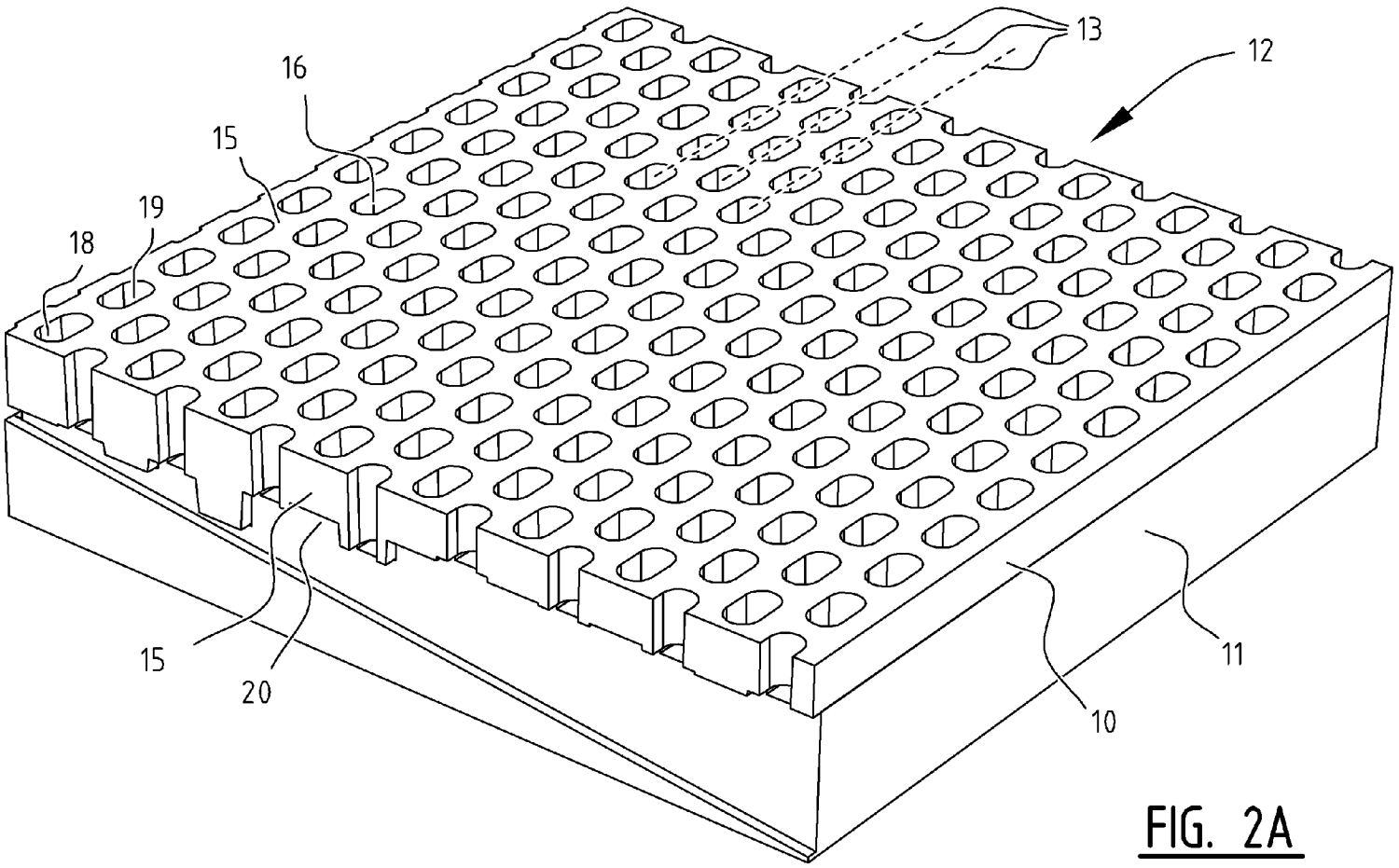
FIG. 2A is a perspective top view of a first embodiment of a diffraction plate according to the invention.
Figure 2B:
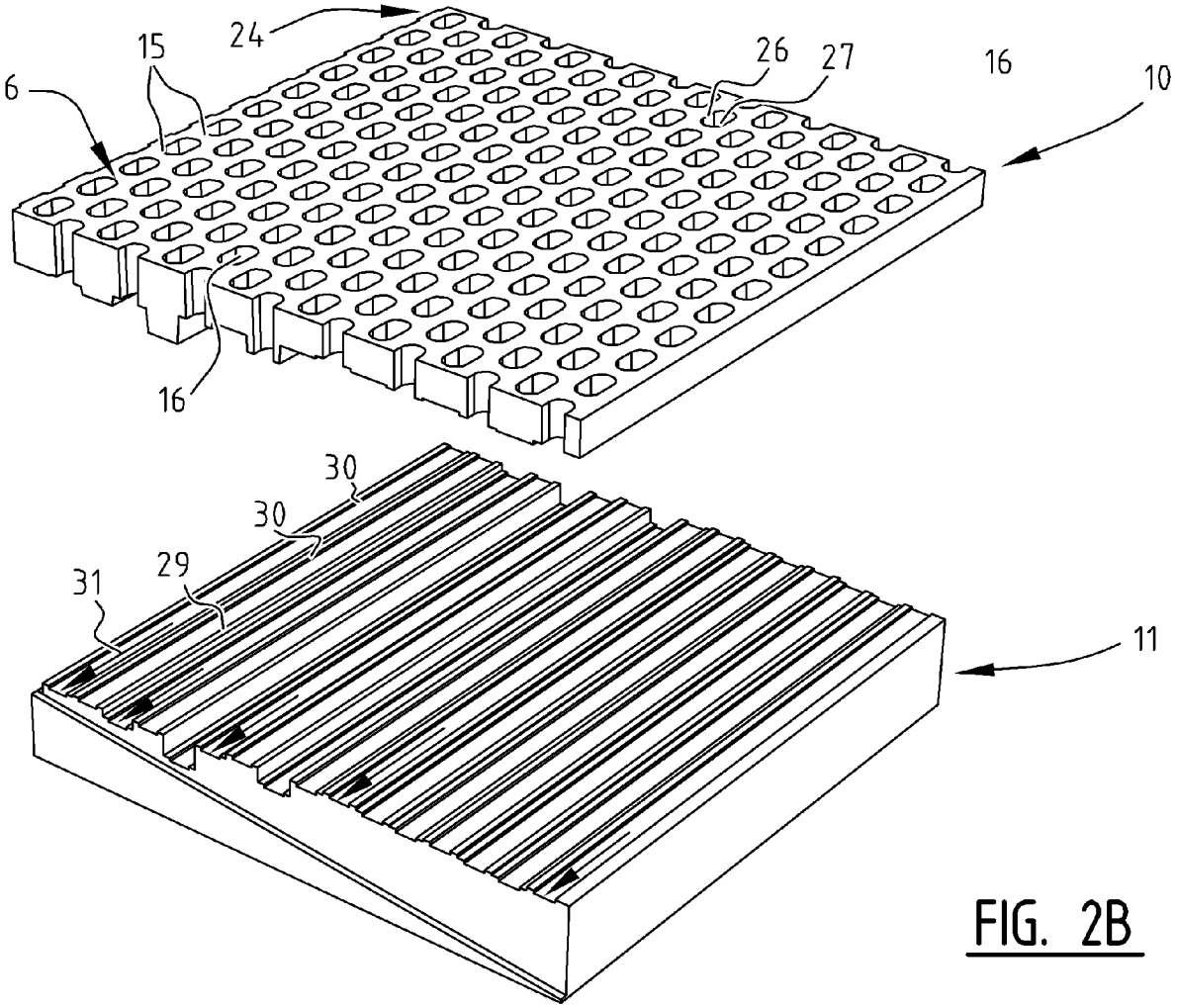
FIG. 2B is an exploded perspective top view of the diffraction element of FIG. 2A in which a lower and upper plate are shown.
Figure 2C:
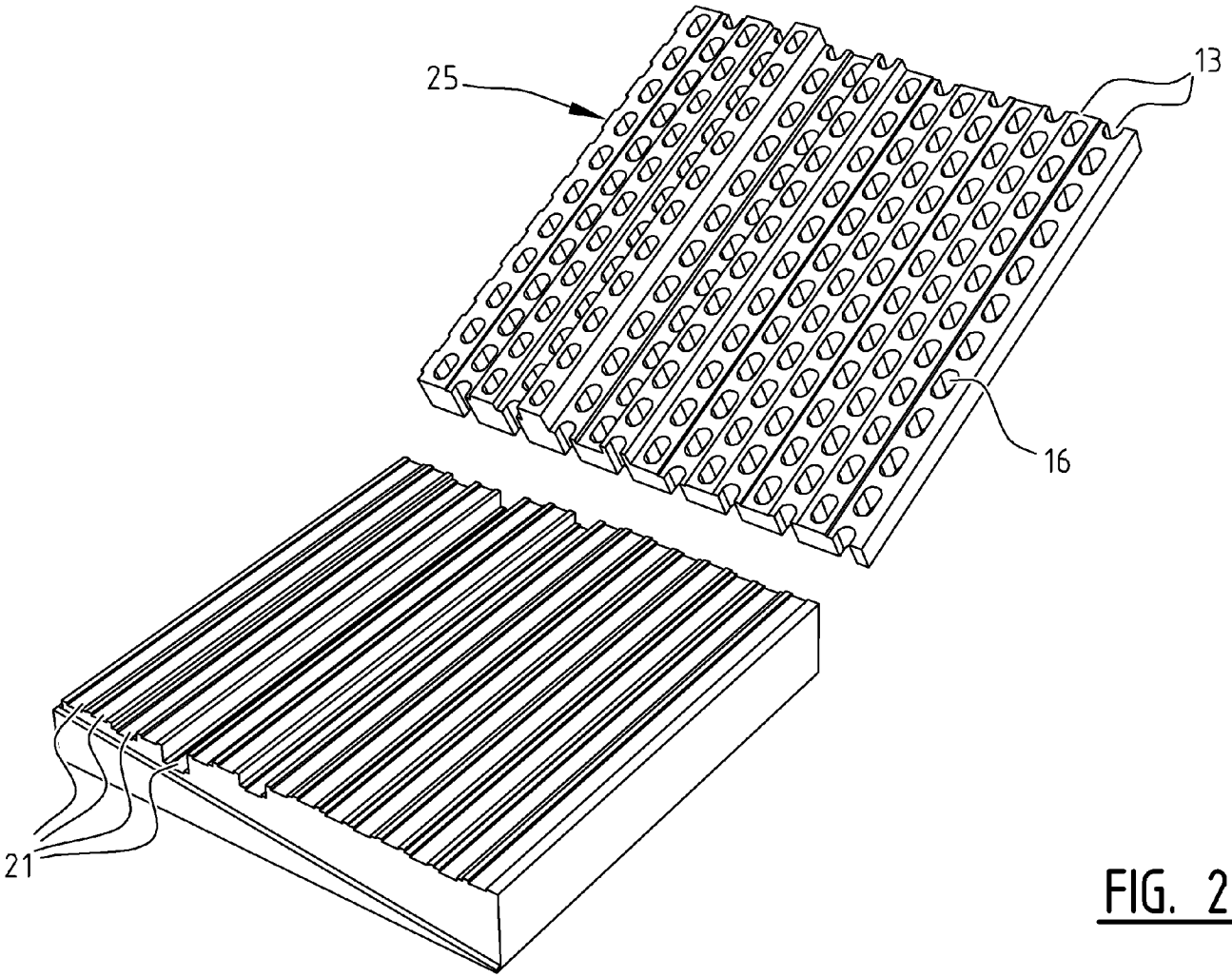
FIG. 2C is a perspective view of the upper side of the lower plate and the underside of the upper plate of the embodiment of the invention shown in FIGS. 2A and 2B.

FIGS. 2A-2C show a determined embodiment of such a diffraction element in more detail. The diffraction element according to this embodiment is plate-like. In the shown embodiment diffraction element 12 comprises an upper plate 10 and a separate lower plate 11. Upper plate 10 is a plate with a substantially flat upper side 24. A large number of recesses 6 is arranged in the plate. Each of the recesses 6 forms a row 13, wherein the rows of recesses run substantially parallel to each other. Each recess 6 is divided into different compartments using standing intermediate walls 15. Each compartment forms a resonator 16.

In the shown embodiment the number of rows 13 equals sixteen. In other embodiments the number of rows can of course be smaller or greater.

The individual resonators in a determined row 13 preferably all have the same depth. The depths of resonators 16 generally differs however in different rows 13. In the shown embodiment the depth of successive rows (as seen from the travel surface in lateral direction 45) for instance sometimes decreases and sometimes increases. In other embodiments the shown embodiment can be modified so that the depth of each successive row decreases.

Each of the resonators 16 is constructed from a number of standing walls (usually vertical, although inclining walls are also possible), more particularly a front wall 26, rear wall 27 and two intermediate walls 15. Each of the walls is manufactured from acoustically hard (i.e. substantially non-absorbing) material and resonators 16 are further empty. This means that no absorbing material or other type of material is present in the resonators.

FIGS. 2A-2C also show a lower plate 11. This lower plate 11 is preferably flat on the underside and provided on the upper side with a number of grooves 29. Grooves 29 extend parallel to each other and are dimensioned and arranged such that each groove can be placed directly below an associated row of recesses. Provided on the two longitudinal sides of each groove are upright edges 30 on which the underside 25 of upper plate 10 can rest.

Each of the intermediate walls 15 is embodied on the underside thereof such that a gap is present between the underside thereof and associated groove 29. The groove forms the bottom of the recess. The intermediate space between the underside of the intermediate wall and the bottom functions as throughflow opening 20 for water which has found its way into the resonators.

Because a throughflow opening 20 is present between each of the intermediate walls 15 and the bottom of the associated grooves 29, the water can flow from the one resonator to the other. In order to initiate the flow of water grooves 29 are placed at an incline, which means that they slope to some extent. Under the influence of gravitational force a flow of water is hereby set into motion through the successive throughflow openings in direction 31 (FIG. 2B). In the shown embodiment the incline is such that the throughflow of the water through the throughflow opening takes place in a single direction 31 at a time. In other embodiments it is however also possible to have a part of the water flow in one direction and another part of the water in the other direction, for instance alternately per row.

Said throughflow opening 20 can be realized in that the bottom of groove 29 is deepened to some extent relative to the upper side of edges 30. In other embodiments the bottom is however flat, and the edges are omitted. The throughflow opening is formed in this embodiment by shortening the intermediate walls 15 on the underside. An opening is hereby created between the underside of the intermediate walls and the bottom. In yet another embodiment the throughflow opening is created by shortening the intermediate wall to some extent as well as giving the bottom a deepened form.

Because the throughflow openings provide for drainage of the rainwater, the action of the resonators will not deteriorate, or at least less so, when water gets into them. Because the drainage via the throughflow openings further takes place via the side surfaces of the resonators and since openings 20 are located in or under intermediate walls 15, the throughflow openings have no or hardly any effect on the acoustic properties of the resonators. This is caused by the fact that, since the sound waves are largely incident perpendicularly of the rows, no difference in sound pressure occurs in longitudinal direction of the resonators. No wave propagation therefore occurs in longitudinal direction, and sound does not therefore leak from one resonator to the other. The operation of the resonators hereby remains substantially intact, despite the presence of the throughflow openings.

The above described first embodiment of a diffraction element is plate-like and is therefore also referred to as a diffraction plate. In other embodiments the diffraction elements are embodied as paving stones or bricks (for instance moulded clinkers), wherein one brick or more bricks together form the above described resonators.

Figure 3A:
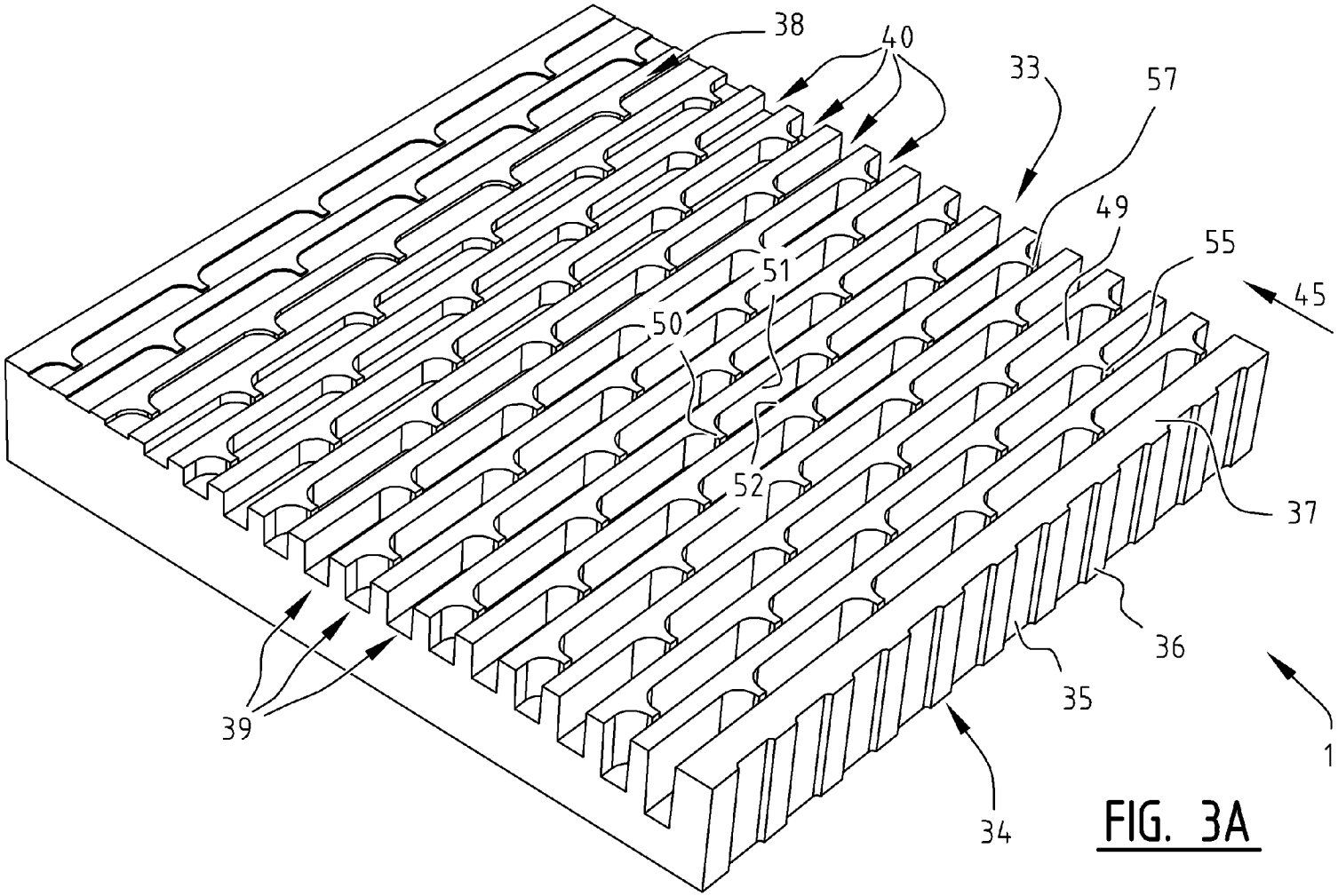
FIG. 3A is a perspective view of a second embodiment of a diffraction plate according to the invention.
Figure 3B:
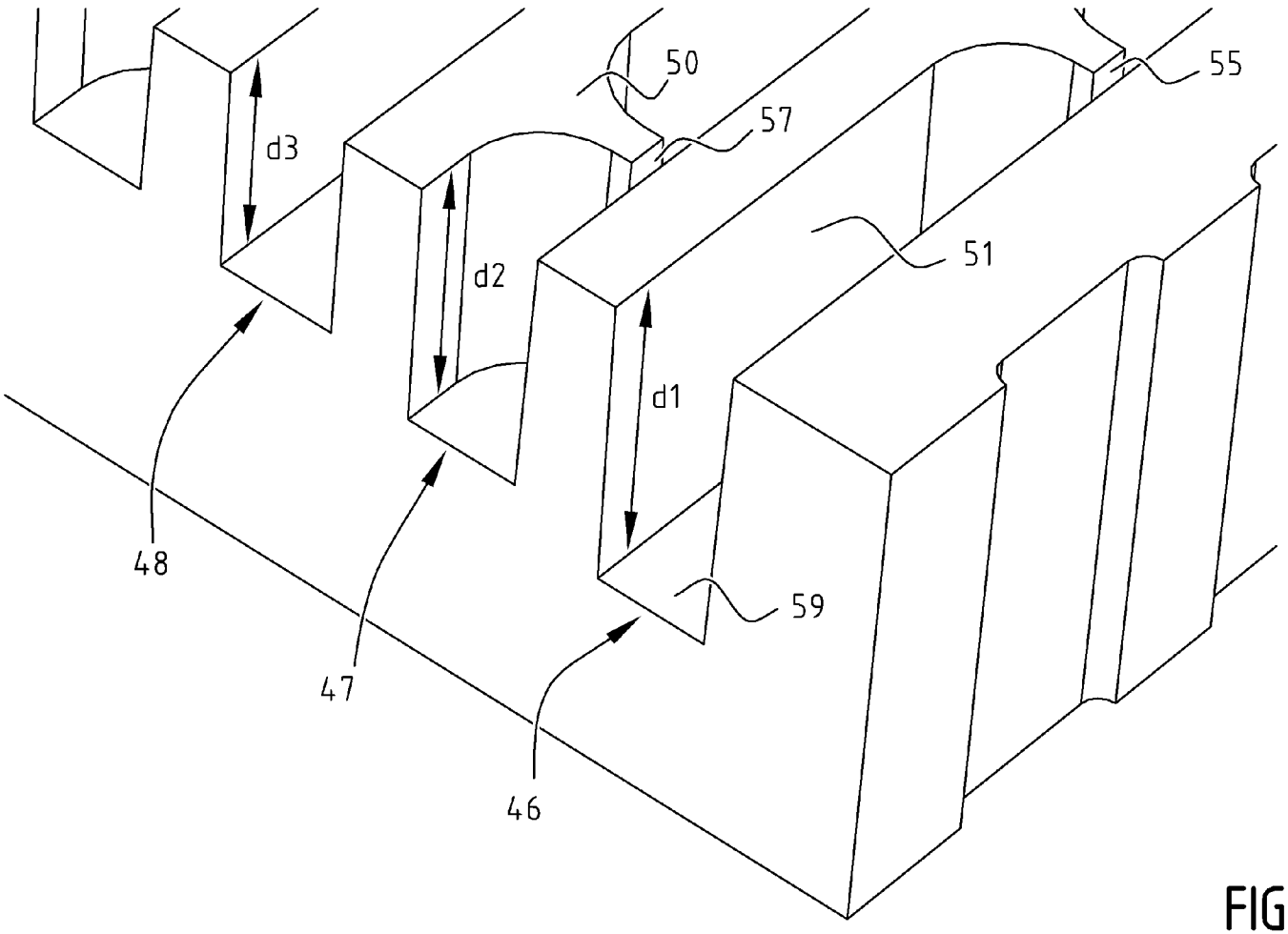
FIG. 3B is a detail view of the first (front) four resonators rows of the second embodiment.
Figure 4:
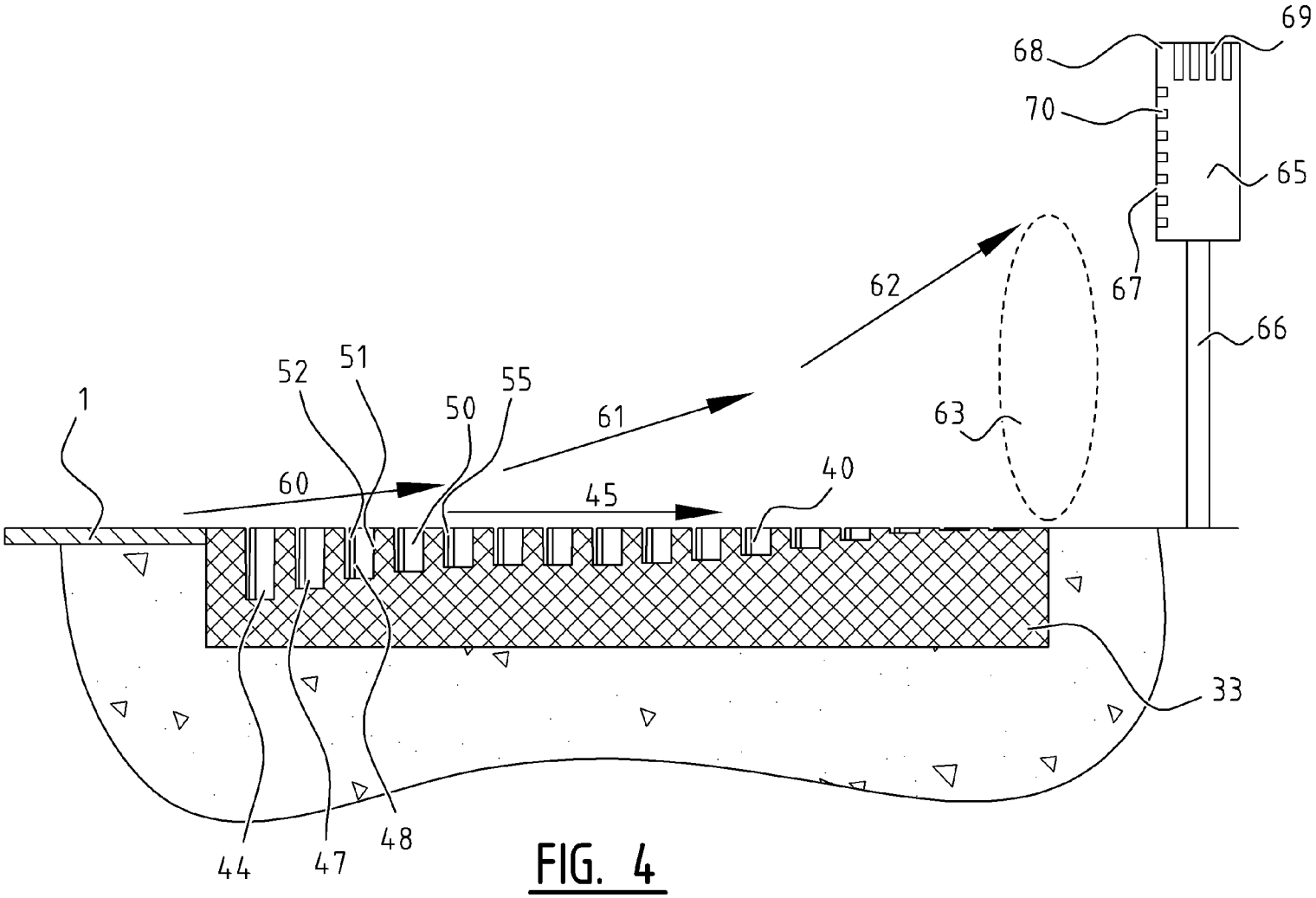
FIG. 4 is a partially cut-away view of an embodiment of an assembly of a carriageway and a diffractor according to the second embodiment, wherein a noise-reducing screen is arranged adjacently of the diffractor.

FIGS. 3A and 3B and the left-hand part of FIG. 4 show a second embodiment of a diffraction element 33 according to the invention. In this embodiment the element has an integral construction. The element particularly takes a wholly releasing form, which makes it easily possible to produce the plate in a mould. Diffraction element 33 is provided on the side 34 facing toward travel surface 1 with a number of upright recesses 35. The edges 36 adjacently of these recesses are preferably arranged against the side of carriageway 1. Recesses 35 enable downward drainage of rainwater and dirt which lands on the lying edge 37 of plate 33. Dirt from the travel surface can hereby be prevented from finding its way into the resonators located therebehind.

A number of elongate recesses 39 are once again arranged in upper side 38 of diffraction plate 33. Each of the recesses forms a row 40, wherein the recesses are arranged substantially parallel to each other and have a distance increasing in each case relative to the travel surface (as seen from the travel surface 1 in a direction 45 away from the travel surface, perpendicularly of the longitudinal axis of travel surface 1). Each recess 39 of a row 40 is divided into individual resonators by means of intermediate walls 50.

Referring to FIG. 3B, the depth $d_1$ of first row 46 is greater than the depth $d_2$ of second row 47. The depth $d_2$ of second row 47 is in turn likewise greater than the depth $d_3$ of third row 48, and so on. Although this need not necessarily be the case in all embodiments, in the shown embodiment the depth of the resonators decreases monotonically in each case in successive resonator rows 40.

As stated above, each recess 39 is divided into individual resonators by means of intermediate walls 50. In contrast to the intermediate walls in the first embodiment, which mutually connect standing walls 26, 27 and form as it were partitions between the two walls, intermediate walls 50 are formed such that a standing, gap-like throughflow opening 55 is present between at least one of the standing walls 51, 52. In the shown embodiment throughflow opening 55 is provided on the travel surface side dof resonator 49, i.e. on the side of wall 52 located closest to travel surface 1. Throughflow opening 55 is formed by having the free outer end 57 of each intermediate wall 50 end some distance (characteristically about 5 mm) from the opposite wall 52 of resonator 49. This throughflow opening 55 extends over substantially the whole height of the resonator and also to the bottom thereof. This makes it possible for water which may have got into the resonators to flow quickly from the one resonator via throughflow opening 55 to an adjacent resonator. By now providing all resonators with such openings it is possible to transport the rainwater from one resonator to another resonator and further in the direction of a further water drain.

In a preferred embodiment the bottoms 59 of recesses 39 take a form inclining to some extent relative to the travel surface so that the water flows in one determined direction under the influence of gravitational force, preferably in the direction of the further water drain (not shown).

It is also the case in this embodiment that, due to the location of the throughflow opening, i.e. on the side of the resonators and therefore not in one of the walls or in the bottom, the relevant acoustic properties of the resonators are not affected, or hardly so, while water can still be drained so as to keep the resonators free of water.

As already set forth, the depth of the recesses in the diffraction element preferably decreases from row to row (as the distance relative to the travel surface increases). The cross-section of the second embodiment of the diffraction element shown in FIG. 4 for instance shows that there are sixteen rows of resonators, wherein the first row of resonators is the deepest (typically 8 cm deep or, in the case of car traffic, 15 cm deep) and the subsequent rows of recesses become increasingly less deep. It has been found that, when this sequence of depths is applied, a surprisingly high noise reduction can be realized in the relevant frequency range. It has further been found that the at least three, preferably four, but most preferably at least ten successively placed rows of recesses have a depth decreasing in each case in order to realize a high sound attenuation. Even if the depth increases again after a series of rows of decreasing depth, the results remain reasonably good. Embodiments in which three successive recesses therefore have an increasing depth produce good results, and certainly when these three recesses are located relatively close to the source (for instance in the first 6 rows), also already provide good results. It is however recommended that all rows have a monotonically decreasing depth.

Figure 5A:
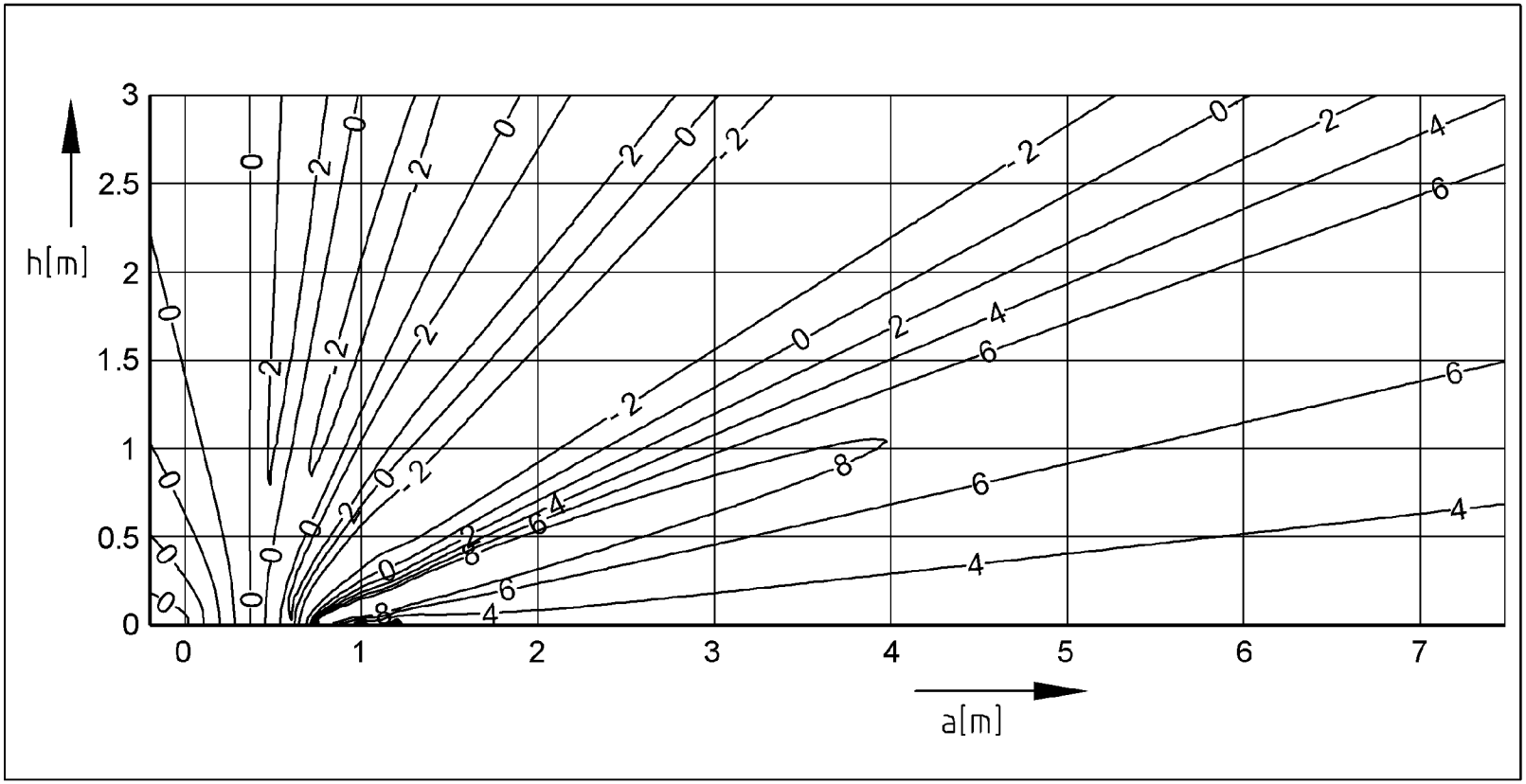
FIG. 5A is a graph showing the noise reduction (in dB) for sound with a frequency of 1000 Hz resulting from the presence of a diffractor.

FIG. 5A shows the results of the simulation of a sound field diffracted by a diffractor according to an embodiment of the invention. The source is located 3 cm (h=0.03 m) above the ground, at a=0.3 m. The diffractor consists of slots of about 3 cm wide at a mutual spacing of 2 cm. The width of the throughflow openings (drainage gaps) is 5 mm and the intermediate distance between the intermediate walls amounts to about 10 cm. The first resonator lies at a distance of 75 cm from the source and depths are respectively 79, 65, 54, 47, 43, 42, 40, 36, 28, 17, 4, 1, 1, 1, 1, 1 mm (plate dimensions about 80×80 cm). The noise reduction is shown at a frequency of 1000 Hz. The noise reduction at about 7.5 m from the source thus varies between about 4 and 7 decibel. Similar reductions are feasible at other frequencies related to traffic noise (for instance between 500 Hz and 1200 Hz).

Figure 5B:
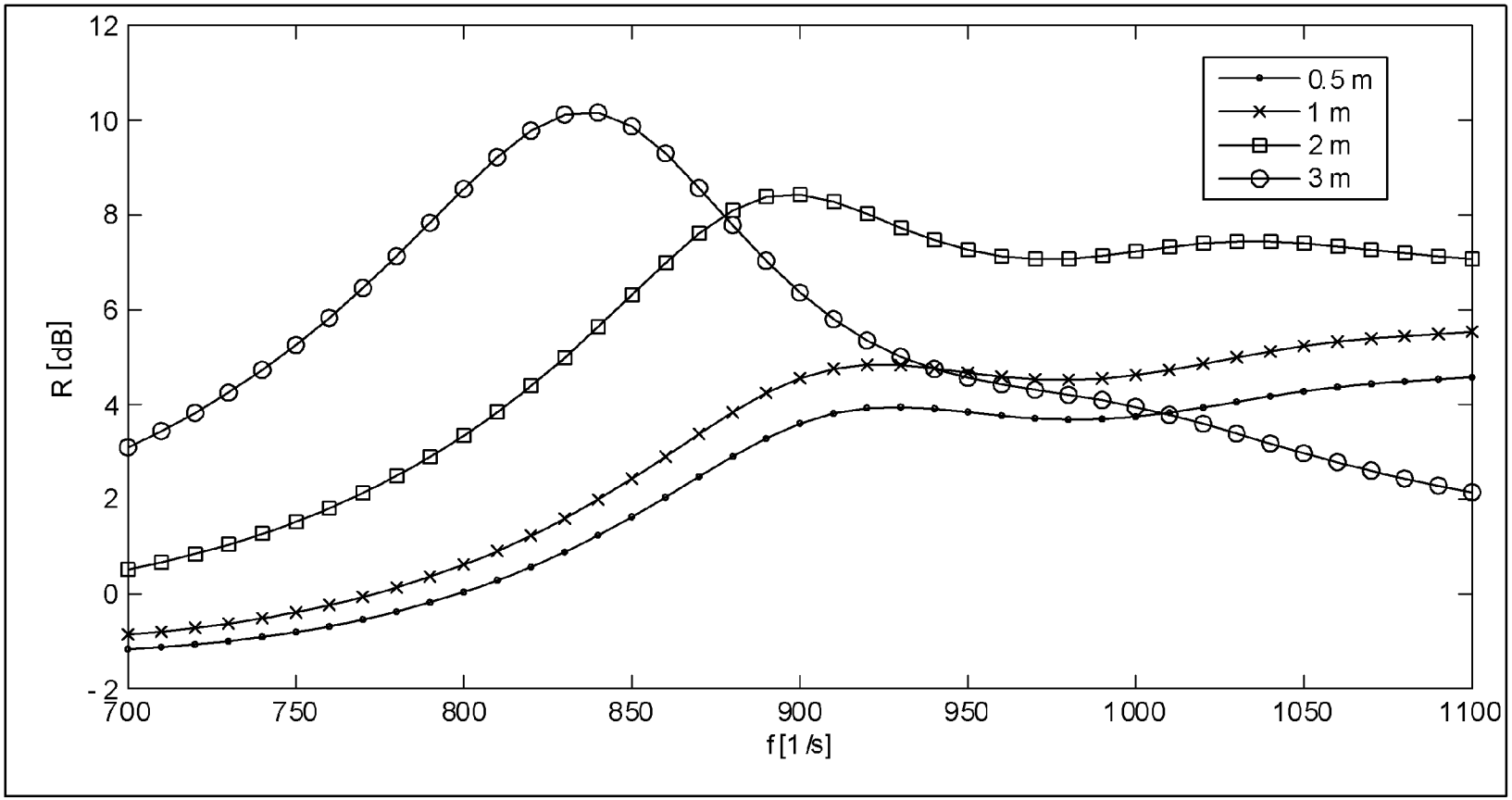
FIG. 5B is a graph of the noise reduction (R) at 7.5 m from the sound source behind the diffractors and at different heights as a function of the frequency (f) for the situation of FIG. 5A.

FIG. 5B shows a graph in which the reduction as a result of the diffractor is shown as a function of the frequency and at different heights, at 7.5 m from the source. At low frequency the reduction is thus highest at 3 m.

FIG. 4 shows a further embodiment of the invention. In the situation of FIG. 4 a number of the diffraction plates 33 shown in FIGS. 3A-B are placed along travel surface 1. The diffraction plate is provided in the above described manner with a number of resonators. Arrows 60, 61, 62 indicate that sound waves coming from travel surface 1 are first incident in shearing manner (direction 60) on the diffraction plate and are diffracted upward (direction 61, 62) by the resonators. The sound forms as it were a diffraction lobe in which the sound is carried away obliquely upward. This means that an area (designated schematically with 63) is created under the diffraction lobe in which there is some measure of sound attenuation in the desired predetermined frequency range. In order to prevent the sound finding its way above said area 63 from also causing nuisance, in this embodiment a noise-reducing screen 65 is arranged at a greater distance from the travel surface, although preferably in the vicinity thereof. Noise-reducing screen 65 is arranged on a support 66. This support can take a relatively light form and is preferably embodied such that the traffic participants on travel surface 1 can see therethrough. Noise-reducing screen 65 is provided in known manner some distance above the ground. This noise-reducing screen can reflect the sound incident thereon. The surface of noise-reducing screen 65 facing toward travel surface 1 preferably takes an absorbing form. The surface can be provided for this purpose with an absorbent material layer 70. It is further possible to also arrange further diffractors 69 on the upper side 68 of noise-reducing screen 65 for further diffraction of sound waves shearing therealong.

Noise-reducing screen 65 has the advantage compared to a traditional noise-reducing screen that it can take an open form on the underside (i.e. at the position of support 66) so that the traffic participant has a view of his or her surroundings and/or the wind has less influence on the construction. The construction of support and noise-reducing screen can hereby take a lighter form, and a heavy foundation construction can be dispensed with.

In other embodiments of the invention (not shown) the resonators are formed more deeply than in the embodiment of FIGS. 3 and 4. When the diffraction element is applied along a quiet road surface, for instance a sound-absorbing road surface, the peak of the traffic noise lies at a lower level, characteristically around 700 Hz. It has been found that somewhat deeper recesses can preferably better be applied in such situations. It has further been found that the diffraction effect is more robust with the deeper resonators. The effect becomes noticeable at lower frequencies, while the effect is still maintained sufficiently at higher frequencies.

According to a particularly advantageous embodiment, recesses with respective depths of 142, 131, 121, 114, 109, 107, 107, 107, 105, 102, 97, 90, 82, 75, 72 mm (±3 mm) are applied in a sequence as seen from the travel surface. The intermediate distance between the intermediate walls amounts to about 16 cm. The width of the recesses amounts to for instance 35 mm (±5 mm).

In determined embodiments the walls of the recesses take an inclining form. The width of a recess is more particularly greater on the upper side than the width at the bottom of the recess. This ensures that the recesses have a releasing form, which simplifies the manufacture of the diffraction elements. Such diffraction elements are further easy to keep clean.

The present invention is not limited to the above described embodiments. The rights sought are defined by the following claims, within the scope of which numerous modifications can be envisaged.

The invention claimed is:

1. A diffractor for diffracting sound of traffic on a travel surface, the diffractor comprising at least one diffraction element disposed in a lateral direction beside the travel surface, wherein the at least one diffraction element comprises a pattern of recesses in the upper surface thereof, wherein the at least one diffraction element is configured for diffracting a traffic noise in a direction which differs from the lateral direction, wherein each of the recesses is divided into individual resonators by intermediate walls provided in the recesses, wherein each of the recesses has an acoustically substantially non-absorbing wall and is free of an acoustically absorbing material, and wherein the intermediate walls between adjacent resonators comprise at least one throughflow opening configured to allow rainwater to flow from the one resonator to another, wherein the diffraction element comprises a lower plate and an upper plate placeable thereon and wherein the bottom of the recesses is formed by the upper side of the lower plate and the recesses are arranged only in the upper plate.

2. The diffractor according to claim 1, wherein the recesses take an elongate form and wherein each of the recesses is divided into a row of elongate recesses arranged successively and separated from each other via one or more intermediate walls.

3. The diffractor according to claim 1, wherein an intermediate wall comprises a throughflow opening at the position of one of the walls of the recess.

4. The diffractor according to claim 3, wherein the throughflow opening is provided between the wall of a recess to be positioned closest to the sound source and a free outer end of an associated intermediate wall.

5. The diffractor according to claim 1, wherein the throughflow opening is located between the underside of the intermediate wall and the bottom of the recess.

6. The diffractor according to claim 5, wherein the bottom is deepened over at least a part thereof.

7. The diffractor according to claim 1, wherein the bottom of a recess lies at an incline.

8. The diffractor according to claim 1, wherein the diffraction element is formed integrally and/or has a releasing form.

9. The diffractor according to claim 1, wherein the depth of the recesses decreases monotonically per row as a lateral distance relative to the travel surface increases.

10. The diffractor according to claim 1, wherein the depth of at least four of the number of successive parallel rows decreases.

11. The diffractor according to claim 1, wherein a porosity defined as an overall mouth surface area of the recesses divided by an overall upper surface area of a diffraction plate is at least 10%.

12. The diffractor according to claim 1, wherein the recesses are slot-like, the width of a resonator is about 3 cm, the width of a wall between adjacent rows of recesses is about 2 cm, a width of the throughflow openings is about 0.5 cm, and an intermediate distance between an intermediate wall of a resonator is less than 20 cm.

13. The diffractor according to claim 1, wherein the diffraction element is manufactured from concrete, plastic, metal, or a combination thereof.

14. The diffractor according to claim 1, wherein a resonance frequency of the resonators is about 500 Hz to about 1500 Hz.

15. The diffractor according to claim 1, wherein the depths of the resonators vary between 15 cm and 1 cm.

16. A travel surface assembly for traffic, the travel surface assembly comprising at least one row of diffractors according to claim 1, wherein:

the travel surface assembly for traffic comprises a travel surface comprising a traffic road for motorized road traffic, a railway for train traffic, or a combination thereof, andthe at least one row of diffractors is configured to limit a lateral emission of a sound frequency from a sound source travelling over the travel surface, wherein the sound frequency is within a predetermined range.

17. The travel surface assembly for traffic according to claim 16, wherein the row of diffractors is arranged directly adjoining the travel surface.

18. The travel surface assembly for traffic according to claim 16, wherein the upper side of the diffraction element extends at least at roughly the same height as the surface of the travel surface.

19. The travel surface assembly for traffic according to claim 16, further comprising a noise-reducing screen disposed behind the at least one row of diffractors, wherein the noise-reducing screen is configured to reflect, absorb, or reflect and absorb sound diffracted by the at least one row of diffractors.

20. The travel surface assembly for traffic according to claim 19, comprising a support configured to support the noise-reducing screen at a distance above the ground.

21. The travel surface assembly for traffic according to claim 16, wherein the recesses are configured to produce a maximum sound reduction at a distance of about 6 m to about 10 m from the travel surface and at a height of about 3 m from the travel surface.

22. The diffractor according to claim 1, wherein the depths of all of the mutually adjacent recesses decreases.

23. The diffractor according to claim 1, wherein the recesses widen at least partially from the mouth to the bottom.

24. The diffractor according to claim 1 wherein the recesses narrow at least partially from the mouth to the bottom.

25. The diffractor according to claim 11, wherein the porosity is more than 50%.

26. The diffractor according to claim 11, wherein the porosity is more than 70%.

27. The diffractor according to claim 11, wherein the porosity is more than 80%.

28. The diffractor according to claim 12, wherein the intermediate distance between the intermediate wall of the resonator is about 10 cm.

29. The diffractor according to claim 13, wherein the diffraction element is manufactured from glass fibre-reinforced polyester, recycled polyethylene, steel-reinforced plastic, iron, steel, or a combination thereof.

30. The diffractor according to claim 14, wherein the resonance frequency of the resonators is about 700 Hz to about 1200 Hz.

31. A diffractor for diffracting sound of traffic on a travel surface, the diffractor comprising at least one diffraction element disposed in a lateral direction beside the travel surface, wherein the at least one diffraction element comprises a pattern of recesses in the upper surface thereof, wherein the at least one diffraction element is configured for diffracting a traffic noise in a direction which differs from the lateral direction, wherein each of the recesses is divided into individual resonators by intermediate walls provided in the recesses, wherein each of the recesses has an acoustically substantially non-absorbing wall and is free of an acoustically absorbing material, and wherein the intermediate walls between adjacent resonators comprise at least one throughflow opening configured to allow rainwater to flow from the one resonator to another, wherein the recesses are arranged along the travel surface in a number of successive parallel rows of resonators, wherein a depth of the recesses decreases per row in a direction away from the travel surface, and wherein the depths of ten of the mutually adjacent rows decreases.

* * * * *